US008584415B2

(12) United States Patent
Stahl, Jr. et al.

(10) Patent No.: US 8,584,415 B2
(45) **Date of Patent: *Nov. 19, 2013**

(54) FIRESTOPPING SEALING MEANS FOR USE WITH GYPSUM WALLBOARD IN HEAD-OF-WALL CONSTRUCTION

(71) Applicant: Specified Technologies Inc., Somerville, NJ (US)

(72) Inventors: James P. Stahl, Jr., Princeton, NJ (US); James P. Stahl, Sr., Stockton, NJ (US); Julio Lopes, Dunellen, NJ (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/694,340

(22) Filed: Nov. 20, 2012

(65) Prior Publication Data

US 2013/0091790 A1 Apr. 18, 2013

Related U.S. Application Data

(63) Continuation of application No. 12/803,667, filed on Jul. 1, 2010, now Pat. No. 8,375,666.

(60) Provisional application No. 61/277,335, filed on Sep. 23, 2009, provisional application No. 61/270,839, filed on Jul. 14, 2009.

(51) Int. Cl.
*E04B 1/94* (2006.01)

(52) U.S. Cl.
USPC ..... 52/317; 52/232; 52/287.1; 52/394; 52/396.01

(58) Field of Classification Search
USPC ..... 52/232, 241, 242, 287.1, 317, 394, 52/396.01
See application file for complete search history.

(56) References Cited

U.S. PATENT DOCUMENTS

| | | | |
|---|---|---|---|
| 2,109,655 | A | 3/1938 | Sylvan |
| 2,111,634 | A | 3/1938 | Kotrbaty |
| 2,180,317 | A | 11/1939 | Davis |
| 2,252,578 | A | 8/1941 | Powell |
| 2,717,062 | A | 9/1955 | Dusing et al. |
| 2,915,150 | A | 12/1959 | Weidler |
| 2,971,616 | A | 2/1961 | Bayley, Jr. |
| 3,062,338 | A | 11/1962 | Ridder et al. |

(Continued)

FOREIGN PATENT DOCUMENTS

| | | | | |
|---|---|---|---|---|
| EP | 346126 A2 | * | 12/1989 | ..... E04B 1/94 |
| GB | 2118225 A | * | 10/1983 | ..... E04B 1/94 |

*Primary Examiner* — Adriana Figueroa

(74) *Attorney, Agent, or Firm* — Sperry, Zoda & Kane

(57) ABSTRACT

A sealing gasket for use attached preferably to the topmost edge of gypsum board when used as construction wallboard. The gasket includes a support leg section capable of being mounted in engagement with preferably the uppermost edge of the gypsum board. The gasket includes a sealing leg extending outwardly from said leg section which includes an intumescent component to facilitate sealing between the edge of the gypsum board and the wall structure above. In one embodiment the sealing leg includes an intumescent impregnated paper material covered with a structurally enhancing layer. An adhesive layer can be included to attach the gasket to the gypsum wallboard. The sealing leg in this embodiment has an "A" or "P" profile and will extend upwardly and inwardly over the upper edge of the gypsum board at an obtuse angle with respect to the support leg for sealing thereabove in the head-of-wall area.

22 Claims, 3 Drawing Sheets

(56) References Cited

U.S. PATENT DOCUMENTS

| | | | | | |
|---|---|---|---|---|---|
| 3,170,269 | A | | 2/1965 | Dunnington | |
| 3,197,119 | A | | 7/1965 | Hartig et al. | |
| 3,217,453 | A | | 11/1965 | Medow | |
| 3,231,644 | A | | 1/1966 | Chang | |
| 3,264,165 | A | | 8/1966 | Stickel | |
| 3,273,297 | A | | 9/1966 | Wehe, Jr. | |
| 3,315,429 | A | | 4/1967 | Swanson | |
| 3,357,146 | A | | 12/1967 | Gartrell | |
| 3,501,868 | A | | 3/1970 | Ganzinotti | |
| 3,508,368 | A | | 4/1970 | Tischuk et al. | |
| 3,601,942 | A | | 8/1971 | Wilson | |
| 3,786,604 | A | * | 1/1974 | Kramer | 52/232 |
| 3,805,471 | A | | 4/1974 | De Schutter | |
| 3,854,253 | A | | 12/1974 | Slowbe | |
| 4,155,208 | A | | 5/1979 | Shanabarger | |
| 4,182,085 | A | | 1/1980 | Elson | |
| 4,364,212 | A | | 12/1982 | Pearson et al. | |
| 4,399,645 | A | | 8/1983 | Murphy et al. | |
| 4,424,867 | A | | 1/1984 | Mallow | |
| 4,449,341 | A | | 5/1984 | Taglianetti et al. | |
| 4,531,332 | A | | 7/1985 | Gartner | |
| 4,733,514 | A | | 3/1988 | Kelly | |
| 4,758,003 | A | * | 7/1988 | Goldstein et al. | 277/314 |
| 4,866,898 | A | * | 9/1989 | LaRoche et al. | 52/396.01 |
| 4,869,037 | A | | 9/1989 | Murphy | |
| 4,884,381 | A | | 12/1989 | Betti | |
| 5,088,249 | A | | 2/1992 | Marzouki | |
| 5,127,203 | A | | 7/1992 | Paquette | |
| 5,127,425 | A | | 7/1992 | Cornwall | |
| 5,127,760 | A | | 7/1992 | Brady | |
| 5,129,201 | A | * | 7/1992 | Robertson et al. | 52/232 |
| 5,155,957 | A | | 10/1992 | Robertson et al. | |
| 5,183,070 | A | | 2/1993 | Cornwall | |
| 5,187,910 | A | * | 2/1993 | Nicholas et al. | 52/317 |
| 5,293,724 | A | | 3/1994 | Cornwall | |
| 5,365,713 | A | * | 11/1994 | Nicholas et al. | 52/573.1 |
| 5,390,465 | A | | 2/1995 | Rajecki | |
| 5,417,019 | A | | 5/1995 | Marshall et al. | |
| 5,471,805 | A | * | 12/1995 | Becker | 52/241 |
| 5,498,466 | A | | 3/1996 | Navarro et al. | |
| 5,655,350 | A | | 8/1997 | Patton | |
| 5,744,199 | A | | 4/1998 | Joffre et al. | |
| 5,765,332 | A | * | 6/1998 | Landin et al. | 52/396.01 |
| 5,887,395 | A | | 3/1999 | Navarro et al. | |
| 5,921,041 | A | | 7/1999 | Egri, II | |
| 6,058,668 | A | | 5/2000 | Herren | |
| 6,112,488 | A | * | 9/2000 | Olson et al. | 52/393 |
| 6,125,608 | A | | 10/2000 | Charlson | |
| 6,128,874 | A | * | 10/2000 | Olson et al. | 52/232 |
| 6,131,352 | A | * | 10/2000 | Barnes et al. | 52/396.01 |
| 6,176,053 | B1 | | 1/2001 | Germain | |
| 6,189,277 | B1 | | 2/2001 | Boscamp | |
| 6,418,689 | B1 | | 7/2002 | Hacquard et al. | |
| 6,698,146 | B2 | | 3/2004 | Morgan et al. | |
| 6,783,345 | B2 | * | 8/2004 | Morgan et al. | 425/110 |
| 7,043,880 | B2 | * | 5/2006 | Morgan et al. | 52/2.23 |
| 7,152,385 | B2 | * | 12/2006 | Morgan et al. | 52/745.05 |
| 7,240,905 | B1 | * | 7/2007 | Stahl, Sr. | 277/652 |
| 7,424,793 | B1 | | 9/2008 | Shriver | |
| 7,435,369 | B2 | | 10/2008 | Hennis et al. | |
| 2002/0056242 | A1 | | 5/2002 | Andresen | |
| 2007/0175140 | A1 | | 8/2007 | Giannos | |
| 2008/0172960 | A1 | * | 7/2008 | Hilburn | 52/232 |

* cited by examiner

FIRESTOPPING SEALING MEANS FOR USE WITH GYPSUM WALLBOARD IN HEAD-OF-WALL CONSTRUCTION

The present utility application hereby formally claims priority of currently pending U.S. Provisional Patent application No. 61/270,839 filed Jul. 14, 2009 on "SEALING MEANS FOR GYPSUM WALLBOARD" filed by the inventors, James P. Stahl Jr. et al and assigned to SPECIFIED TECHNOLOGIES INC. of Somerville, N.J.

The present utility application also hereby formally claims priority of U.S. Provisional Patent application No. 61/277,335 filed Sep. 23, 2009 on "PLANAR SEALING MEANS FOR GYPSUM WALLBOARD" filed by inventors, James P. Stahl Jr. et al and assigned to SPECIFIED TECHNOLOGIES INC. of Somerville, N.J.

The present utility application hereby formally claims priority of currently pending U.S. Utility patent application Ser. No. 12/803,667 filed Jul. 1, 2010 on "FIRESTOPPING SEALING MEANS FOR USE WITH GYPSUM WALLBOARD IN HEAD-OF-WALL CONSTRUCTION" filed by the inventors, James P. Stahl Jr. et al, and assigned to SPECIFIED TECHNOLOGIES INC. of Somerville, N.J.

The above three referenced patent applications are hereby formally incorporated by reference as an integral part of the present application

BACKGROUND OF THE INVENTION

1. Field of the Invention

The present invention deals with the field of firestop sealing devices positionable between the upper edge of the gypsum wallboard and the lower edge of a floor located thereabove commonly defined as the head-of-wall area of building construction. Many of these floor configurations can have various shapes and designs and a need exists for a means of sealing this area in the event of a fire to prevent passage of unwanted flames, heat and gases therebetween. The present invention is particularly useful when attached with respect to any of the commonly available top of wall constructions. The flexibly resilient intumescent gasket of the present design is very useful for the purpose of replacing the common current practice of utilizing filler materials such as caulk or firestopping mastic materials in the otherwise opened head-of-wall joint areas beneath floor and above the gypsum wallboard therebelow. Use of such materials is labor intensive and the quality of the final fire seal is greatly dependent on the skill level of the on-site worker.

2. Description of the Prior Art

Many patents have been granted for various constructions for the purpose of sealing the opened head-of-wall joint areas between gypsum wallboard and the lower surface of a floor or ceiling construction located immediately thereabove such as shown in U.S. Pat. No. 2,109,655 patented Mar. 1, 1938 to J. Sylvan on a "Building Construction"; and U.S. Pat. No. 2,111,634 patented Mar. 22, 1938 to G. F. Kotrbaty and assigned to Ferrocon Corporation on a "Building Structure And Joint Therefor"; and U.S. Pat. No. 2,180,317 patented Nov. 14, 1939 to C. F. Davis and assigned to American Cyanamid & Chemical Corporation on a "Metal Decking"; and U.S. Pat. No. 2,291,616 patented Aug. 4, 1942 to J. Fletcher and assigned to The Plastergon Wall Board Company on a "Method Of Coating Webs"; and U.S. Pat. No. 2,616,866 to W. Juda and assigned to Pyrotron Development Corporation on a "Fire Retardant"; and U.S. Pat. No. 2,717,062 patented Sep. 6, 1955 to L. F. Dusing et al and assigned to Dusing & Hunt, Inc. F. H. Saino Manufacturing Company on a "Fire Door"; and U.S. Pat. No. 2,915,150 patented Dec. 1, 1959 to R. W. Weidler on a "Basement Assembly And Prefabricated Structural Units Therefor"; and U.S. Pat. No. 2,926,928 patented Mar. 1, 1960 to W. Bennett and assigned to Utility Trailer Manufacturing Company on a "Unitary Floor And Frame Structure For Vehicles"; and U.S. Pat. No. 3,062,338 patented Nov. 6, 1962 to E. J. De Ridder et al and assigned to Reynolds Metals Company on "Double Faced Panels"; and U.S. Pat. No. 3,151,663 patented Oct. 6, 1964 to W. A. Bohner et al and assigned to General Motors Corporation on an "Inflatable Closure Apparatus"; and U.S. Pat. No. 3,170,269 patented Feb. 23, 1965 to J. B. Dunnington and assigned to Butler Manufacturing Company on a "Base Channel Panel Footing Structure"; and U.S. Pat. No. 3,217,453 patented Nov. 16, 1965 to R. S. Medow and assigned to Leonard I. Vogel on a "Facing Structure And Article"; and U.S. Pat. No. 3,231,644 patented Jan. 25, 1966 to M. Y. Chang on a "Method And Apparatus For Building Construction"; and U.S. Pat. No. 3,269,072 patented Aug. 30, 1966 to J. J. Black and assigned to Pullman Incorporated on a "Vehicle Floor Construction"; and U.S. Pat. No. 3,273,297 patented Sep. 20, 1966 to H. W. Wehe, Jr. and assigned to Overly Manufacturing Company on a "Door And Panel Construction"; and U.S. Pat. No. 3,315,429 patented Apr. 25, 1967 to W. D. Swanson and assigned to National Steel Corporation on a "Wall Construction And Element"; and U.S. Pat. No. 3,328,926 patented Jul. 4, 1967 to K. Reinhard and assigned to Ador Corporation on an "Inflatable Housing Construction"; and U.S. Pat. No. 3,343,324 patented Sep. 26, 1967 to W. Gordon and assigned to William Gordon and Eve Gordon on an "Underwater Structural Unit"; and U.S. Pat. No. 3,357,142 patented Dec. 12, 1967 to J. F. Furrer et al and assigned to the United States of America as represented by the Secretary of the Army on a "Foam Plastic Shelter"; and U.S. Pat. No. 3,357,146 patented Dec. 12, 1967 to J. T. Gartrell and assigned to Birdsboro Corporation on a "Building Panel Splicing"; and U.S. Pat. No. 3,414,320 patented Dec. 3, 1968 to G. Heim and assigned to Daimler-Benz Aktiengesellschaft on a "Sliding Roof, Especially for Motor Vehicles"; and U.S. Pat. No. 3,501,868 patented Mar. 24, 1970 to J. V. Ganzinotti and assigned to Equipment Moderne Industriel par application du Caoutchonc Manufacture et des Plastiques EMI on "Sealing Joints"; and U.S. Pat. No. 3,508,368 patented Apr. 28, 1970 to W. Tischuk et al and assigned to H. H. Robertson Company on a "Building Panel Having Tapered Counter-Sunk End Portion And Method Of Erecting The Same"; and U.S. Pat. No. 3,601,942 patented Aug. 31, 1971 to J. D. Wilson on a "Building Wall Construction"; and U.S. Pat. No. 3,631,644 patented Jan. 4, 1972 to L. Mazza and assigned to Industrie A. Zanussi S.p.A. on a "Sectional Frame For Refrigerators"; and U.S. Pat. No. 3,786,604 patented Jan. 22, 1974 to F. Kramer and assigned to U.F. Chemical Corp. on a "Fire Stop Between Floor Slab And Curtain Wall Of Building"; and U.S. Pat. No. 3,854,253 patented Dec. 17, 1974 to J. A. Slowbe on a "Joint Construction Between Supported And Supporting Members"; and U.S. Pat. No. 4,044,510 patented Aug. 30, 1977 to L. O'Neal on a "Venting Valve For Inflatable Dock Seals"; and U.S. Pat. No. 4,045,925 patented Sep. 6, 1977 to L. O'Neal on an "Inflatable Dock Seal And Mounting Therefor"; and U.S. Pat. No. 4,155,208 patented May 22, 1979 to J. A. Shanabarger on "Building Insulation And Method Of Installation"; and U.S. Pat. No. 4,188,756 patented Feb. 19, 1980 to S. O. B. Ljungbo and assigned to Erecta AG on a "Heat-Insulated Plastic Hall"; and U.S. Pat. No. 4,267,609 patented May 19, 1981 to G. Altman et al and assigned to Thermasol Ltd. on a "Gasket Assembly For Coupling Drainage Outlet Openings In Bathtub Liner Installations"; and U.S.

Pat. No. 4,399,645 patented Aug. 23, 1983 to P. D. Murphy et al and assigned to Lou Weitz, Jeriline Ward and Joy Murphy on a "Bladder Insulation"; and U.S. Pat. No. 4,449,341 patented May 22, 1984 to P. C. Tagianetti et al and assigned to PPG Industries, Inc. on a "Fire Containment Arrangement For Curtain Wall Construction"; and U.S. Pat. No. 4,455,802 patented Jun. 26, 1984 to J. Charniga on "Wire Screen Fire Stops"; and U.S. Pat. No. 4,531,332 patented Jul. 30, 1985 to K. Gartner and assigned to Yoshid Kogyo K. K. on a "Rooftop Parapet For Thermally-Insulated Curtain Wall"; and U.S. Pat. No. 4,676,032 patented Jun. 30, 1987 to P. Jutras on an "Inflatable Wall Structure"; and U.S. Pat. No. 4,679,373 patented Jul. 14, 1987 to B. Ludwig on a "Method And Device For The Aligning Of An Element, E.G. Frame, To Be Inserted Into A Wall Opening"; and U.S. Pat. No. 4,733,514 patented Mar. 29, 1988 to T. L. Kelly on a "Building Construction With Meltable Insulation And Reservoir Trough Therefor"; and U.S. Pat. No. 4,866,898 patented Sep. 19, 1989 to A. R. LaRoche et al and assigned to Manville Corporation on a "Fire Resistant Expansion Joint"; and U.S. Pat. No. 4,869,037 patented Sep. 26, 1989 to J. J. Murphy on a "Wall Construction"; and U.S. Pat. No. 4,918,897 patented Apr. 24, 1990 to C. W. Luedtke on a "Construction System For Detection Structures And Multiple Story Buildings"; and U.S. Pat. No. 5,048,257 patented Sep. 17, 1991 to C. W. Luedtke on a "Construction System For Detection Structures And Multiple Story Buildings"; and U.S. Pat. No. 5,088,249 patented Feb. 18, 1992 to T. Marzouki and assigned to Roland-Werke Dachbaustoffe and Bauschemie GmbH & Co. KG on a "Roof Covering Or Wall Covering"; and U.S. Pat. No. 5,187,910 patented to J. D. Nicholas et al on Feb. 23, 1993 and assigned to MM Systems Corporation on a "Fire Barrier System"; and U.S. Patent No. 5,417,019 patented May 23, 1995 to D. P. Marshall et al and assigned to Lamson & Sessions Co. on a "Passthrough Device With Firestop"; and U.S. Pat. No. 5,655,350 patented Aug. 12, 1997 to B. L. Patton on a "Method For Retro-Fit Forming Firestops In Existing Wall Structures With Blown Insulation"; and U.S. Pat. No. 5,765,332 patented Jun. 16, 1998 to H. V. Landin et al and assigned to Minnesota Mining And Manufacturing Company on a "Fire Barrier Protected Dynamic Joint"; and U.S. Pat. No. 6,058,668 patented May 9, 2000 to T. R. Herren on a "Seismic And Fire-Resistant Head-Of-Wall Structure"; and U.S. Pat. No. 6,125,608 patented Oct. 3, 2000 to J. A. Charlson and assigned to United States Building Technology, Inc. on "Composite Insulated Framing Members And Envelope Extension System For Buildings"; and U.S. Pat. No. 6,131,352 patented Oct. 17, 2000 to V. Barnes et al on a "Fire Barrier"; and U.S. Pat. No. 6,418,689 patented Jul. 16, 2002 to P. Hacquard and assigned to Someta on a "Removable Wall System"; and U.S. Pat. No. 6,698,146 patented Mar. 2, 2004 to M. D. Morgan et al and assigned to W. R. Grace & Co.-Conn. on "In Situ Molded Thermal Barriers"; and U.S. Pat. No. 6,783,345 patented Aug. 31, 2004 to M. D. Morgan et al and assigned to W. R. Grace & Co.-Conn. on "In Situ Molded Thermal Barriers"; and U.S. Pat. No. 7,043,880 patented May 16, 2006 to M. D. Morgan and assigned to W. R. Grace & Co.-Conn. on "In Situ Molded Thermal Barriers"; and U.S. Pat. No. 7,152,385 patented Dec. 26, 2006 to M. D. Morgan et at and assigned to W. R. Grace & Co.-Conn. on "In Situ Molded Thermal Barriers"; and U.S. Pat. No. 7,424,793 patented Sep. 16, 2008 to J. C. Shriver and assigned to Thermafiber, Inc. on an "Interlocking Curtain Wall Insulation System".

OBJECTS OF THE INVENTION

It is an object of the planar sealing means for gypsum wallboard of the present invention to provide a system which minimizes cost.

It is an object of the planar sealing means for gypsum wallboard of the present invention to provide a less labor intensive means for achieving full sealing of the edges wallboard than is currently being used particularly in the open zone area beneath the floor construction thereabove and to provide a planar sealing gasket which is attachable to the edge of the wallboard such that the surrounding sealing means is automatically placed simultaneously whenever the gypsum wallboard itself is placed in position.

It is an object of the planar sealing means for gypsum wallboard of the present invention to provide a system which is easily maintained.

It is an object of the planar sealing means for gypsum wallboard of the present invention to provide a system which can be attached to one side of the gypsum wallboard prior to installation such that the gypsum wallboard and the firestopping means are positioned simultaneously.

It is an object of the planar sealing means for gypsum wallboard of the present invention to provide a system which is flexibly resilient to allow for relative movement between the wallboard and the top-of-the-wall construction immediately thereadjacent beneath a floor thereabove.

It is an object of the planar sealing means for gypsum wallboard of the present invention to provide a system which can be made of intumescent paper material.

It is an object of the planar sealing means for gypsum wallboard of the present invention to provide a system which will include a structural layer preferably of polyethylene or foil-scrim.

It is an object of the planar sealing means for gypsum wallboard of the present invention to provide a system which can include an adhesive layer which may comprise pressure sensitive adhesive tape.

It is an object of the planar sealing means for gypsum wallboard of the present invention to provide a system which can be made available in extended long lengths which can be cut to shape as needed.

It is an object of the planar sealing means for gypsum wallboard of the present invention to provide a system which can be supplied in extended lengths such that it can be coiled to facilitate providing thereof for being cut into whatever lengths are needed for the particular job.

It is an object of the planar sealing means for gypsum wallboard of the present invention to provide a system which is capable of following the contours of a top-of-the-wall length positioned thereadjacent.

It is an object of the sealing means for gypsum wallboard disclosed in the present invention to provide a system which can be made with an intumescent extruded rubber profile which can attach to only one side of the gypsum wallboard.

It is an object of the sealing means for gypsum wallboard disclosed in the present invention to provide a system which can be made with an intumescent extruded rubber profile which can attach simultaneously to both sides of the gypsum wallboard.

It is an object of the sealing means for gypsum wallboard disclosed in the present invention to provide a system which can be made with an intumescent extruded rubber profile which can be attached to the gypsum wallboard prior to securement thereof to the head-of-wall joint area.

It is an object of the sealing means for gypsum wallboard disclosed in the present invention to provide an extruded profile in the shape of an "A" or a "P" which can be adhered to the top edge of the system wallboard prior to placing thereof.

It is an object of the sealing means for gypsum wallboard disclosed in the present invention to provide a sealing gasket that includes a flexible upper rounded section which can be compressed in adjacent with a lower surface of a floor thereabove simultaneously with positioning of the system wallboard in place for attachment to the wall area therebelow.

It is an object of the sealing means for gypsum wallboard disclosed in the present invention to provide a system which can be used with various configurations of building construction including being capable of following the contours of a steel fluted deck floor or roof system.

BRIEF DESCRIPTION OF THE DRAWING

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
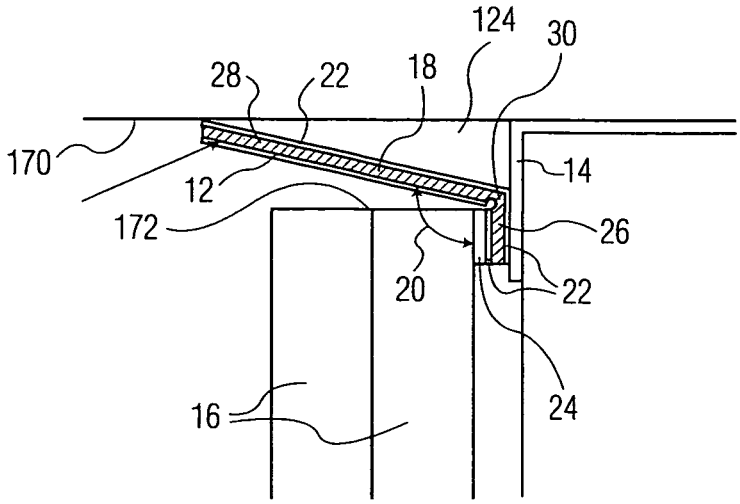
FIG. 1 shows a cross-sectional view of an embodiment of the firestopping sealing means of the present invention shown in position sealing a top-of-the-wall joint utilizing a planar firestopping sealing means extending upwardly and inwardly from the support leg extending over the end edge of gypsum wallboard positioned extending into the adjacent head-of wall joint for firestopping sealing thereof.

The present invention provides a sealing means in the form of a firestopping gasket 12 which is attachable to the edges, preferably the top edges, of gypsum wallboard layers 16 normally positioned often adjacent to steel studs present in such construction. A steel track 14 is shown positioned thereadjacent.

The firestopping gasket 12 will preferably include two sections including a support or mounting leg 26 and a sealing leg 28 attached thereto and preferably formed integrally therewith and extending outwardly therefrom. In the configuration shown in FIG. 1 the support leg 26 and the sealing leg 28 are at oriented at an obtuse angle 20 with respect to one another of slightly greater than 90 degrees.

The construction of the gasket 12 itself includes a base layer of material having an intumescent component such as intumescent impregnated paper 18 in the FIG. 1 embodiment. This material includes a structural layer 22 extending thereover, preferably positioned over both sides thereof which provided added structural strength and rigidity and is more aesthetically pleasing. This structural layer, preferably, is of a thermoplastic material such as polyethylene but it can also be formed of foil scrim commonly used for various purposes in the firestopping industry. The structural layer 22 provides structural integrity to the planar shape of the gasket 12 as shown best in FIG. 1. In particular, the combination of the structural layer 22 and the intumescent impregnated paper 18 provides a combined strength and resiliency to the overall structure of the gasket 12 such that it can maintain shape and impart an element of flexible resilience thereto such that, as shown in FIG. 1, when positioned between the gypsum board layers 16 and the steel track 14, the sealing leg 28 which extends outwardly from the support leg 26 will maintain an obtuse angle 20 to effectively abut with the concrete slab 10 of the upper floor positioned thereabove for firestop sealing thereadjacent. The intumescent paper 18 is flexible such that the added structural layer provides resilient and structural strength thereto. The structural layer 22 is preferably of a thermoplastic material such as polyethylene or other similar material in order to help to maintain the physical orientation between the sealing leg 28 and the support leg 26 as necessary.

One of the important advantages of use of the firestopping gasket 12 of the present invention is in the ease of installation. This advantage is provided by the inclusion of an adhesive layer 24 which can be formed of pressure sensitive adhesive tape or any other common adhesive material such that the sealing leg 28 can be attached easily and quickly to the edge of the gypsum board 16 prior to attachment to the wall at the worksite. Therefore, when the gypsum board layers 16 are secured to the wall the firestopping gasket 12 will be also secured in place with the support leg 26 thereof positioned between the steel track 14 of the wall and the gypsum board layer 16 for securement thereof in place without requiring any special separate labor activity. Normally these areas are sealed by mastic materials such as caulking or the like which requires a separate labor step after mounting the gypsum board which requires additional time and expense because of the labor and materials involved. The present invention achieves the placement of a sealing means between the upper edge of the gypsum board layer 16 and the concrete slab 10 thereadjacent in the top-of-the-wall joint area without any separate step because of the initial placement of the gypsum board layer 16 in the proper location with the gasket of the present invention secured along the edge thereof.

One of the most important aspects of the present invention is the flexibly resilience that is imparted to the firestopping gasket 12 by using a two component material including a layer of intumescent paper 18 and the structural layer 22 of polyethylene or foil-scrim or other similar material. This combined structure provides the intumescent characteristic readily apparent from the intumescent component of paper 18 and it also provides the structural strength and flexible resilience required such that the sealing leg 28 of the FIG. 1 embodiment extends outwardly and upwardly from the upper edge of the gypsum board layer 16 into abutment with respect to the concrete slab thereabove. This double layered construction will help maintain the preset shape of the gasket due to the flexible resilience thereof which maintains forcible abutment of the intumescent sealing portion with respect to the lower surface of the concrete slab 10. In this manner the top-of-the-wall sealing defined below the concrete slab 10 will be maintained sealed at all times despite relative movement between the top-of-the-wall joint and the gypsum board layer 16 commonly experienced in such joints because the sealing leg 28 will flex to accommodate any movement in the relative position due to the flexible resilience in the structure thereof.

Preferably the gasket member of the present invention is provided in extended length and can be coiled to facilitate transport thereof. The providing of this material in such extended lengths will allow the installation personnel to cut the flexibly resilient gasket as needed in sections for fully sealing the open joint area between the top of the gypsum wallboard 18 and the bottom of the floor assembly 122. Also it is preferably that a longitudinally extending cut or slot 30 is defined in the structural layer 22 at the intersection between the sealing leg 28 and the support leg 26. This slot 30 will facilitate bending of the sealing leg 28 to the desired oblique angle relative to the support leg 26. This slot 30 can be manufactured in the original sealing means as manufactured or can be formed in the field by scoring along the intersection between the sealing leg 28 and the support leg 26.

As shown in the embodiments shown in FIGS. 2-5 the use of the sealing means 112 formed as an extruded sealing member 114 is particularly usable with steel fluted deck floor systems. With such a fluted shape in the deck floor the extruded sealing member 114 can be cut to various lengths as needed to provide a full firestopping seal in all areas of the open joint area 124.

Figure 2:
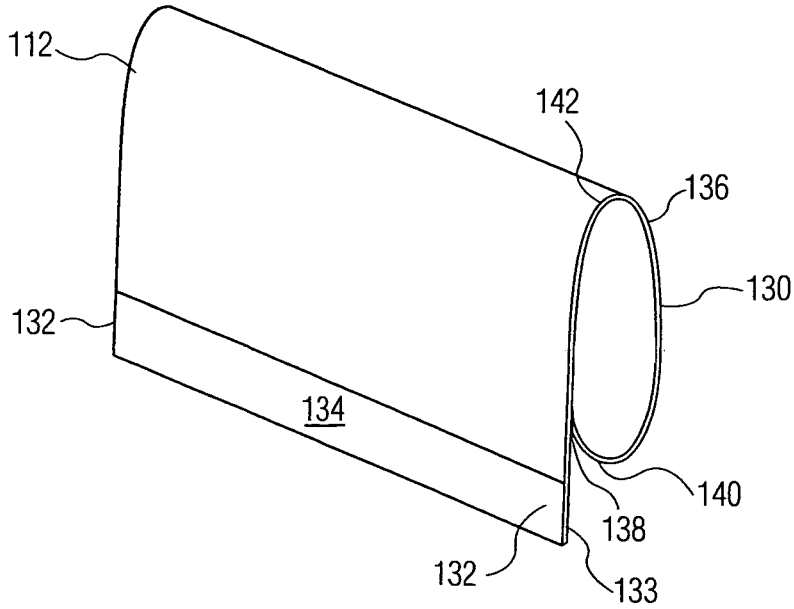
FIG. 2 is a perspective illustration of an embodiment of the sealing leg means of the present invention utilizing a "P-shaped" profile.
Figure 3:
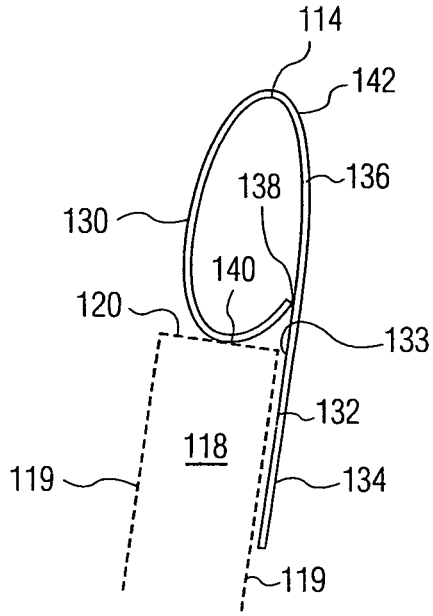
FIG. 3 is an end plan view of the construction of the profile shown in FIG. 2.
Figure 4:
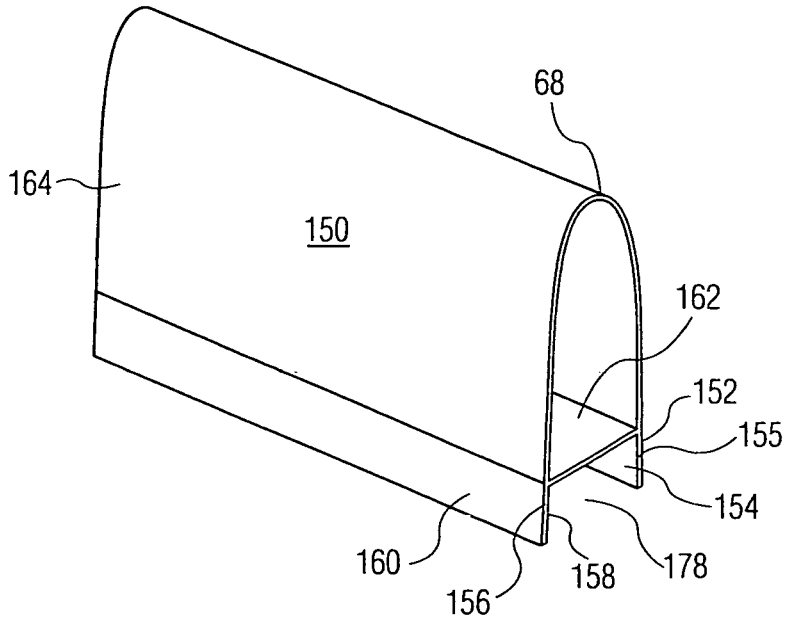
FIG. 4 is a perspective illustration of an embodiment of the sealing means of the present invention shown having an "A-shaped" profile.
Figure 5:
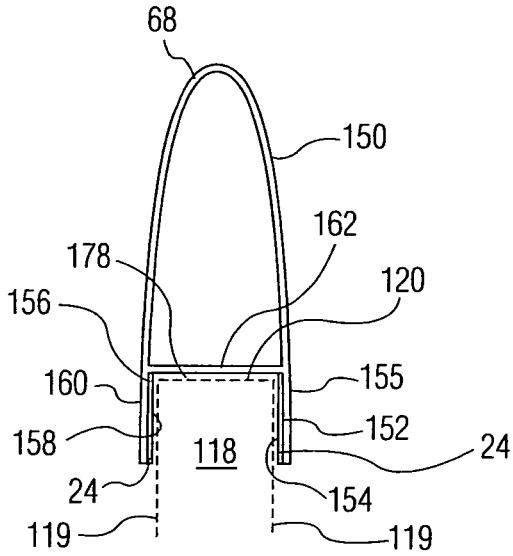
FIG. 5 is an end plan view of the profile of the sealing means shown in FIG. 4.

With the present invention the sealing gasket can be formed conveniently as extruded shaped formed from thermoplastic materials. Two preferred shapes for the thermoplastic extrusion have been found to be useful for this purpose. FIGS. 2 and 3 show the P-shaped profile 130 whereas FIGS. 4 and 5 show the A-shaped profile 150.

The P-shaped profile 130 for the extruded sealing member 114 is formed with a leg section 132 and a rounded section 136 positioned upwardly with respect thereto. The overall construction is actually formed by a singular linear panel which extends from the bottommost portion of leg section 132 upwardly through the rounded section 136 such that it then extends through the area of rounded section 136 with the end of rounded section 138 in abutment with the inner leg surface 133 and the leg section 132 at an intermediate position therealong. The P-shaped profile extrusion also defines an outer leg surface 134.

The leg section 132 provides the means for adherence between the wallboard paper facing 119 which is included along the outermost surfaces of the gypsum wallboard 118 and the extrusion 114. The inner leg surface 133 is positioned in abutment with respect to the gypsum wallboard 118 and can be secured thereto in any conventional manner such as by an adhesive or by threaded fasteners or integral barbs or any other conventional means. Normally a mastic connection will be utilized. In this manner the user can easily secure the inner leg surface 133 of the leg section 132 of the P-profile 130 of the extrusion 114 with respect to the gypsum wallboard 118 prior to positioning and attachment thereof with respect to an adjacent building structure.

The rounded section 136 of the P-shaped profile 130 will include a lower facing rounded section 140 thus positioned in abutment with respect to the gypsum board upper edge 120. The rounded section 136 will also include an upper surface 142 thereof which is designed to be brought into abutment with respect to the bottom of the floor assembly 122. As such, when the gypsum wallboard 118 is placed in abutment with respect to the mounting members to which it is designed to be secured to form a structural wall, the worker will exert an upward force on the gypsum wallboard which urges the upper surface 142 of the rounded section to be forcibly engaged against the bottom of the floor assembly 122. Preferably the material from which the extruded sealing member 114 is made will be a flexibly resilient material such as preferably including a thermoplastic material component such that it will slightly deform and create a resilient bias in firestop sealing between the gypsum wallboard upper edge 120 and the bottom of the floor assembly 122. Thus the rounded section 138 will achieve an effective firestopping seal of the open head-of-wall joint area 124 between the top of the gypsum wallboard and the bottom of the floor assembly immediately. Preferably the extruded material from which the sealing member 114 is made will include an intumescent or other firestopping component for enhancing the firestop sealing of this open joint area 124 when subjected to the heat of a fire.

Another alternative configuration of the profile is shown in FIGS. 4 and 5 wherein the profile is approximately A-shaped. With this A-profile an arcuate upper section 164 will be provided closed at the bottom portion by a generally horizontally extending cross member 162. The combination of the arcuate upper section 164 and the cross member 162 will provide an overall closed section when viewed in side profile as shown best in FIG. 5.

The A-shaped is defined by the inclusion of a first leg section 152 extending downwardly from the cross member 162. A second leg section 156 will also extend downwardly from the cross member 162 at a position spatially disposed from the first leg section 152. In this manner a mounting channel 178 will be defined between the first leg section 152 and the second leg section 156 adapted to receive the gypsum wallboard 118 positioned therebetween.

In particular, the first leg section 152 will include a first inner leg surface 154 and a first outer leg surface 155. The first inner leg surface 154 will be adapted to be positioned in abutment with respect to the wallboard paper facing 119 on one side of the gypsum wallboard 118. The second leg section 156 will include a second inner leg surface 158 and a second outer leg surface 160. The second inner leg surface 158 will be positioned adjacent to the opposite wallboard paper facing 119 of the gypsum wallboard 118. In this manner the first inner leg surface 154 and the second inner leg surface 158 will grasp therebetween the gypsum wallboard 118 to facilitate securement therewith. In this manner, if the lateral spacing between the first inner leg surface 154 and the second inner leg surface 158 is small enough, a wedged or snug friction gripping will occur of the gypsum wallboard 118 and the wallboard paper facings 119 on each opposite side thereof. As such, when using the A-shaped profile 150 for the extruded sealing member 114 in some applications no separate means of securement or adhesion between the extruded member 114 and the gypsum wallboard 118 will be required. That is, in some configurations the spacing will be small enough that a friction gripping of the gypsum wallboard 118 between the legs of the A-shaped profile 150 will be sufficient for securement therebetween. Alternatively, if needed, additional securement means may be included such as adhesives or glues or separate physical fastening means such as screws or nails which can protrude through both the legs and the wallboard can be used.

As such, these two different designs show additional examples of shapes of the extruded sealing members 114 of the present invention can be utilized to form a full seal in the head-of-wall area between the floor 170 and the wall 172 immediately positioned therebelow. When a gypsum wallboard 118 is placed in position the flexibly resilient material of the extruded sealing member 114 will be compressed such that the upper facing arcuate section 68 of the arcuate upper section 164 of the A-shaped profile 150 will be urged into abutting engagement with respect to the bottom of the floor assembly 122 for efficiently creating a firestopping sealing therebetween.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A firestopping sealing means for use with gypsum wallboard in a head-of-wall construction comprising:

A. a support leg being generally planar in shape and being positioned in abutting engagement with respect to a gypsum wallboard adjacent to and along an edge thereof mounted at a head-of-wall construction area;

B. a sealing leg formed of intumescent impregnated thermoplastic material and including an arcuate loop of a singular linear panel which is shaped as a closed loop to facilitate firestopping thereadjacent, said sealing leg being integrally formed with respect to said support leg, said sealing leg being positioned in abutment with respect to the outside edge of the gypsum wallboard thereadjacent to facilitate firestopping, said sealing leg extending outwardly from said support leg to a position between the adjacent outside edge of the gypsum wallboard and the head-of-wall construction thereadjacent; and C. a securement means for selectively maintaining abutting engagement between said support leg and the gypsum wallboard adjacent to and along an edge thereof.

2. A firestopping sealing means for use with gypsum wallboard in a head-of-wall construction as defined in claim 1 wherein said sealing leg extends outwardly from said support leg and further includes:

A. an inner sealing leg surface facing radially inwardly along said arcuate loop;

B. an outer sealing leg surface facing radially outwardly along said arcuate loop; and C. an arcuate loop end means.

3. A firestopping sealing means for use with gypsum wallboard in a head-of-wall construction as defined in claim 1 wherein said arcuate loop end means is positioned in abutment with respect to said inner sealing leg surface to formed said closed loop shape to enhance the structural strength of said arcuate loop of said support leg in order to facilitate firestopping adjacent to the outside end of the adjacent wallboard.

4. A firestopping sealing means for use with gypsum wallboard in a head-of-wall construction as defined in claim 1 wherein said securement means comprises ah adhesive layer positioned on said support leg immediately adjacent the gypsum wallboard to facilitate attachment between said support leg and the adjacent gypsum wallboard.

5. A firestopping sealing means for use with gypsum wallboard in a head-of-wall construction as defined in claim 1 wherein said securement means comprises pressure-sensitive adhesive tape attached to said support leg immediately adjacent the gypsum wallboard to facilitate attachment between said support leg and the adjacent gypsum wallboard.

6. A firestopping sealing means for use with gypsum wallboard in a head-of-wall construction as defined in claim 1 wherein said support leg and said sealing leg are integrally formed as a single extruded part from thermoplastic material impregnated with intumescent material.

7. A firestopping sealing means for use with gypsum wallboard in a head-of-wall construction as defined in claim 1 wherein said support leg and said sealing leg together provide a P-shaped extruded profile.

8. A firestopping sealing means for use with gypsum wallboard in a head-of-wall construction comprising:

A. a support leg means comprising:

(1) a cross member;

(2) a first leg section extending away from said cross member, said first leg section being positioned in abutting engagement with respect to a gypsum wallboard adjacent to and along an edge thereof mounted at a head-of-wall construction area;

(3) a second leg section extending away from said cross member at a position spatially disposed from said first leg section, said second leg section being positioned in abutting engagement with respect to the opposite side of the adjacent gypsum wallboard from said first leg section adjacent to and along an edge thereof mounted at a head-of-wall construction area;

B. a sealing leg integrally formed in the shape of a closed loop of a singular linear panel and which extends away from and outwardly from said support leg means, said sealing leg extending away from said cross member to a position between the adjacent outside edge of the gypsum wallboard and the head-of-wall construction thereadjacent, said closed loop of said sealing leg being formed of intumescent impregnated thermoplastic material to facilitate firestopping thereadjacent; and C. a securement means for selectively maintaining abutting engagement between said support leg and the gypsum wallboard adjacent to and along an edge thereof.

9. A firestopping sealing means for use with gypsum wallboard in a head-of-wall construction as defined in claim 8 wherein said cross member, said first leg section and said second leg section of said support leg means are each generally planar in shape.

10. A firestopping sealing means for use with gypsum wallboard in a head-of-wall construction as defined in claim 8 wherein said first leg section and said second leg section are oriented approximately parallel with respect to one another and approximately perpendicularly with respect to said cross member.

11. A firestopping sealing means for use with gypsum wallboard in a head-of-wall construction as defined in claim 8 wherein said first leg section and said second leg section define therebetween a mounting channel means extending downwardly below said cross member to facilitate receiving the adjacent gypsum wall construction therewithin.

12. A firestopping sealing means for use with gypsum wallboard in a head-of-wall construction as defined in claim 11 wherein the distance between said first leg section and said second leg section defining said mounting channel means is smaller than the size of the gypsum wall board positioned therewithin to facilitate frictional engagement with respect thereto, said securement means being provided by frictional engagement of the gypsum wallboard between said first leg section and said second leg section.

13. A firestopping sealing means for use with gypsum wallboard in a head-of-wall construction as defined in claim 8 wherein said securement means comprises a first adhesive layer positioned on said first leg section of said support leg means immediately adjacent the gypsum wallboard to facilitate attachment between said support leg and the adjacent gypsum wallboard.

14. A firestopping sealing means for use with gypsum wallboard in a head-of-wall construction as defined in claim 13 wherein said securement means further comprises a second adhesive layer positioned on said second leg section of said support leg means immediately adjacent the gypsum wallboard to facilitate attachment between said support leg and the adjacent gypsum wallboard.

15. A firestopping sealing means for use with gypsum wallboard in a head-of-wall construction as defined in claim 13 wherein said first adhesive layer comprises a first pressure-sensitive adhesive tape attached to said support leg immediately adjacent the gypsum wallboard to facilitate attachment between said support leg and the adjacent gypsum wallboard.

16. A firestopping sealing means for use with gypsum wallboard in a head-of-wall construction as defined in claim 14 wherein said second adhesive layer comprises a second pressure-sensitive adhesive tape attached to said support leg immediately adjacent the gypsum wallboard to facilitate attachment between said support leg and the adjacent gypsum wallboard.

17. A firestopping sealing means for use with gypsum wallboard in a head-of-wall construction as defined in claim 8 wherein said sealing leg is attached to said cross member of said supporting leg means at two locations and forms an arcuate loop shape therebetween.

18. A firestopping sealing means for use with gypsum wallboard in a head-of-wall construction as defined in claim 17 wherein said sealing leg is attached to said cross member of said support leg means at a position adjacent said first leg section and extends oppositely outwardly away therefrom and wherein said sealing leg is also attached to said cross member of said support leg means at a position adjacent said second leg section and extends oppositely outwardly away therefrom.

19. A firestopping sealing means for use with gypsum wallboard in a head-of-wall construction as defined in claim 8 wherein said support leg means and said sealing leg are integrally formed as a single extruded part from thermoplastic material impregnated with intumescent material.

20. A firestopping sealing means for use with gypsum wallboard in a head-of-wall construction as defined in claim 8 wherein said support leg means and said sealing leg together provide an A-shaped extruded profile.

21. A firestopping sealing means for use with gypsum wallboard in a head-of-wall construction as defined in claim 17 wherein said sealing leg is flexibly resilient along the arcuate loop shape thereof to facilitate firestop sealing there-adjacent.

22. A firestopping sealing means for use with gypsum wallboard in a head-of-wall construction as defined in claim 8 wherein said cross member is adapted to being positioned in abutting engagement with respect to the outer edge of the gypsum wallboard construction to facilitate firestop sealing thereadjacent.

* * * * *

UNITED STATES PATENT AND TRADEMARK OFFICE

CERTIFICATE OF CORRECTION

PATENT NO. : 8,584,415 B2
APPLICATION NO. : 13/694340
DATED : November 19, 2013
INVENTOR(S) : James P. Stahl, Jr. et al.

It is certified that error appears in the above-identified patent and that said Letters Patent is hereby corrected as shown below:

In the Claims

Column 9

In Claim 4, line 41, change "1" to -- 2 --.

In Claim 5, line 47, change "1" to -- 2 --.

In Claim 6, line 53, change "1" to -- 2 --.

In Claim 7, line 58, change "1" to -- 2 --.

Signed and Sealed this
Twenty-seventh Day of May, 2014

Michelle K. Lee

Michelle K. Lee
*Deputy Director of the United States Patent and Trademark Office*